US010634159B2

(12) United States Patent
Chen et al.

(10) Patent No.: US 10,634,159 B2
(45) Date of Patent: Apr. 28, 2020

(54) HEAT DISSIPATION FAN BLADE STRUCTURE AND HEAT DISSIPATION FAN THEREOF

(71) Applicant: ASIA VITAL COMPONENTS CO., LTD., New Taipei (TW)

(72) Inventors: Yu-Tzu Chen, New Taipei (TW); Chung-Shu Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 211 days.

(21) Appl. No.: 15/350,089

(22) Filed: Nov. 13, 2016

(65) Prior Publication Data

US 2018/0135645 A1 May 17, 2018

(51) Int. Cl.
*F04D 29/38* (2006.01)

(52) U.S. Cl.
CPC ..... *F04D 29/384* (2013.01)

(58) Field of Classification Search
CPC . F01D 5/26; F01D 5/18; F04D 29/544; F04D 29/384
USPC ..... 416/91, 227 R
See application file for complete search history.

(56) References Cited

U.S. PATENT DOCUMENTS 1,604,877 A * 10/1926 Burckhalter ..... F01P 5/02 416/195
4,422,824 A * 12/1983 Eisenhardt, Jr. ..... F04D 25/088 416/146 R
5,554,006 A * 9/1996 Liao ..... F04D 29/384 416/235
6,099,256 A * 8/2000 Silvano ..... F04D 29/325 228/144
2013/0101427 A1* 4/2013 Chen ..... F04D 25/088 416/227 R

* cited by examiner

*Primary Examiner* — Moshe Wilensky
*Assistant Examiner* — Andrew Thanh Bui
(74) *Attorney, Agent, or Firm* — Thomas J. Nikolai; DeWitt LLP

(57) ABSTRACT

A heat dissipation fan blade structure and a heat dissipation fan thereof. The heat dissipation fan blade structure includes a main fan blade and a subsidiary fan blade. The main fan blade has a root section and a free end section. The root section is connected with a hub. The free end section radially extends in a direction away from the hub. A main body section is formed between the root section and the free end section. The subsidiary fan blade extends from the free end section of the main fan blade toward the root section of the main fan blade to the main body section. The subsidiary fan blade and the main fan blade together form a loop structure defining a flow way between the main fan blade and the subsidiary fan blade.

16 Claims, 9 Drawing Sheets

HEAT DISSIPATION FAN BLADE STRUCTURE AND HEAT DISSIPATION FAN THEREOF

BACKGROUND OF THE INVENTION

1. Field of the Invention

The present invention relates generally to the field of heat dissipation fan, and more particularly to a heat dissipation fan blade structure and a heat dissipation fan having the heat dissipation fan blade structure.

2. Description of the Related Art

FIG. 1 shows the fan blade 11 of a conventional axial-flow fan 10. The fan blade 11 has a free end section 111, an upper surface 112 and a lower surface 113. The pressures distributed over the upper and lower surfaces 112, 113 are different so that the airflow will roll from the high-pressure lower surface 113 to the low-pressure upper surface 112 to produce strong wingtip vortices 12 at the free end section 111. The wingtip vortices 12 will lead to unstable flow field of the fan. As a result, the noise is raised and the performance of the fan is lowered.

It is therefore tried by the applicant to provide a heat dissipation fan blade structure and a heat dissipation fan having the heat dissipation fan blade structure to reduce the wingtip vortices in operation of the fan. Also, the heat dissipation fan blade structure can lower the operational noise and enhance wind pressure and air volume so as to enhance the performance of the heat dissipation fan.

SUMMARY OF THE INVENTION

It is therefore a primary object of the present invention to provide a heat dissipation fan blade structure of an axial-flow heat dissipation fan. The heat dissipation fan blade structure has a main fan blade and a subsidiary fan blade extending from a free end section of the main fan blade. The subsidiary fan blade and the main fan blade together form a loop structure to reduce the wingtip vortices of the heat dissipation fan in operation.

It is a further object of the present invention to provide the above heat dissipation fan blade structure. The subsidiary fan blade and the main fan blade together form a loop structure to lower the noise, enhance the wind pressure and air volume and increase structural strength.

It is still a further object of the present invention to provide the above heat dissipation fan blade structure. The subsidiary fan blade serves to increase the surface action area of the main fan blade so as to greatly enhance air volume and wind pressure.

It is still a further object of the present invention to provide the above heat dissipation fan blade structure, in which the wind pressure can be enhanced without increasing the solidity of the fan blades.

It is still a further object of the present invention to provide the above heat dissipation fan blade structure, in which the force applied to local sections by the airflow is distributed so as to reduce the deformation and lower the vibration problem of the fan blades.

To achieve the above and other objects, the heat dissipation fan blade structure of the present invention includes a main fan blade and a subsidiary fan blade. The main fan blade has a root section and a free end section. The root section is connected with a hub. The free end section radially extends in a direction away from the hub. A main body section is formed between the root section and the free end section. The main body section has an upper surface and a lower surface respectively positioned on two opposite faces of the main body section. The subsidiary fan blade extends from the free end section of the main fan blade toward the root section of the main fan blade to the main body section. The subsidiary fan blade and the main fan blade together form a loop structure defining a flow way between the main fan blade and the subsidiary fan blade.

To achieve the above and other objects, the heat dissipation fan of the present invention includes a hub, multiple main fan blades disposed on outer circumference of the hub and multiple subsidiary fan blades. Each main fan blade has a root section and a free end section. The root section is connected with the hub. The free end section radially extends in a direction away from the hub. A main body section is formed between the root section and the free end section. The main body section has an upper surface and a lower surface respectively positioned on two opposite faces of the main body section. Each subsidiary fan blade extends from the free end section of the main fan blade toward the root section of the main fan blade to the main body section. The subsidiary fan blade and the main fan blade together form a loop structure defining a flow way between the main fan blade and the subsidiary fan blade.

In the above heat dissipation fan blade structure, the loop structure is a closed loop body or an open loop body.

In the above heat dissipation fan blade structure, the subsidiary fan blade extends to the upper surface or the lower surface of the main body section.

In the above heat dissipation fan blade structure, the loop structure has a cross section having a hollow configuration selected from a group consisting of trapezoidal shape, rectangular shape, curved shape, drip shape and semicircular shape.

In the above heat dissipation fan blade structure, the main fan blade and the subsidiary fan blade are integrally formed or are two separate pieces of components, which are connected with each other by means of riveting, latching, adhesion, locking, welding or fusion.

In the above heat dissipation fan blade structure, the main fan blade defines a radial stretching length and the subsidiary fan blade defines an extension length. The extension length is smaller than, equal to or larger than the radial stretching length.

In the above heat dissipation fan blade structure, the subsidiary fan blade includes a first section connected with the free end section of the main fan blade, a second section extending from the first section toward the root section of the main fan blade and a third section extending from the second section to the main body section of the main fan blade.

In the above heat dissipation fan blade structure, the subsidiary fan blade includes a first section connected with the free end section of the main fan blade and a second section obliquely extending from the first section toward the root section of the main fan blade to the main body section of the main fan blade.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
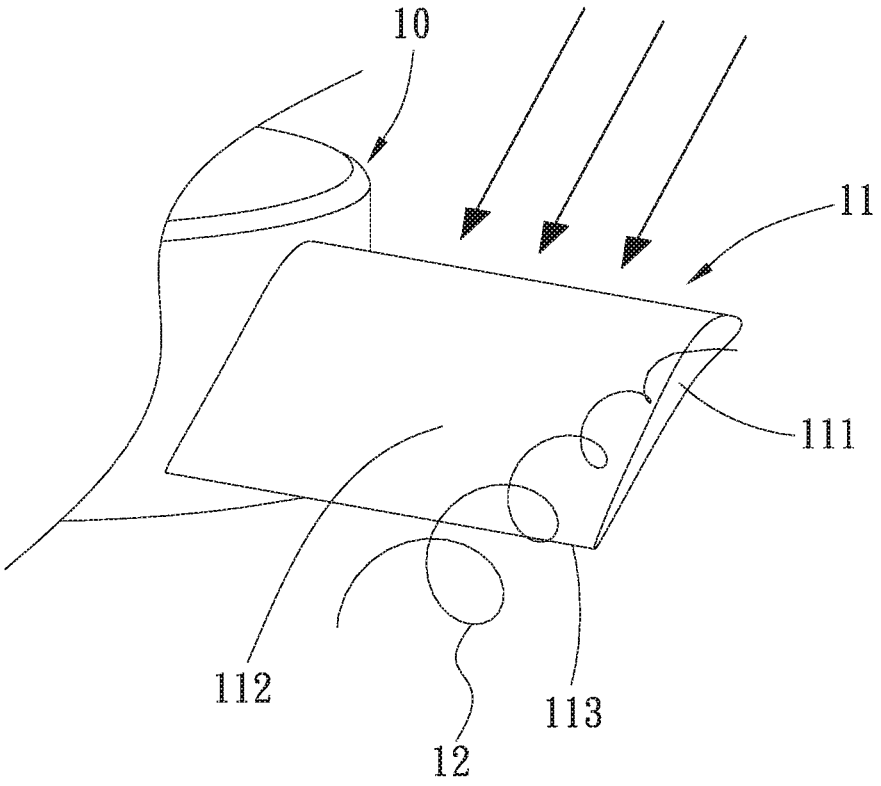
(prior art) Fig. 1
FIG. 1 is a perspective view of a conventional fan blade.
Figure 2:
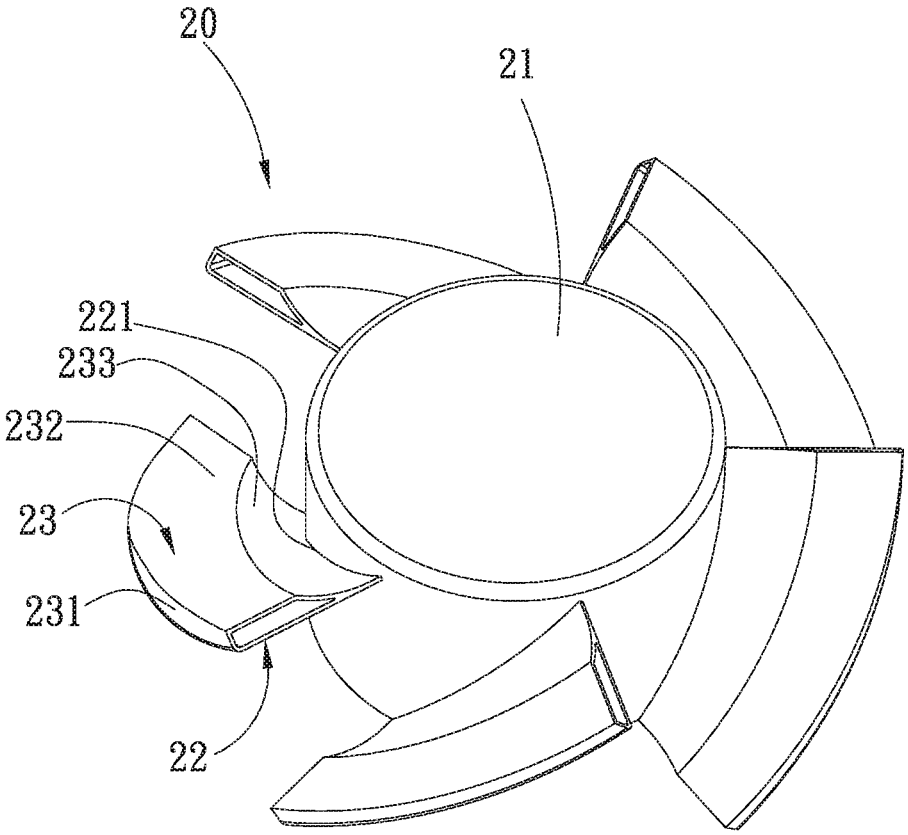
FIG. 2 is a perspective view of the heat dissipation fan with the heat dissipation fan blade structure of the present invention.
Figure 3A:
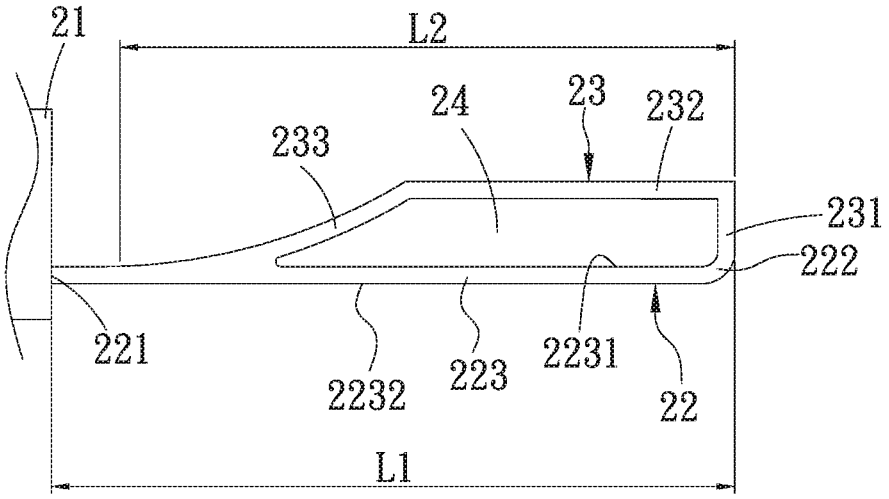
FIG. 3A is a sectional view of the loop structure of the heat dissipation fan blade structure of the present invention.

Please refer to FIGS. 2, 3A and 3B to 3F. FIG. 2 is a perspective view of the heat dissipation fan with the heat dissipation fan blade structure of the present invention. FIG. 3A is a sectional view of the loop structure of the heat dissipation fan blade structure of the present invention. FIGS. 3B to 3F are sectional views of several modified embodiments of the loop structure of the heat dissipation fan blade structure of the present invention. The heat dissipation fan 20 of the present invention includes a hub 21 and multiple main fan blades 22. The main fan blades 22 are annularly arranged around an outer circumference of the hub 21. Each main fan blade 22 has a root section 221 and a free end section 222. The root section 221 and the free end section 222 are respectively positioned at two ends of the main fan blade 22. The root section 221 is connected with the hub 21. The free end section 222 radially extends in a direction away from the hub 21. A main body section 223 is formed between the root section 221 and the free end section 222. The main body section 223 has an upper surface 2231 and a lower surface 2232 respectively positioned on two opposite faces of the main body section 223. Each main fan blade 22 has a subsidiary fan blade 23. The subsidiary fan blade 23 extends from the free end section 222 of the main fan blade 22 toward the root section 221 of the main fan blade 22 to the main body section 223. The subsidiary fan blade 23 and the main fan blade 22 together form a loop structure defining a flow way 24 between the main fan blade 22 and the subsidiary fan blade 23.

Figure 3B:
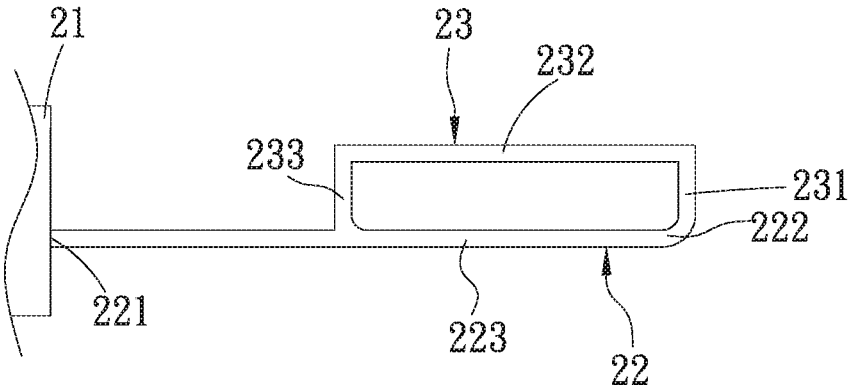
FIGS. 3B to 3F are sectional views of several modified embodiments of the loop structure of the heat dissipation fan blade structure of the present invention.
Figure 3C:
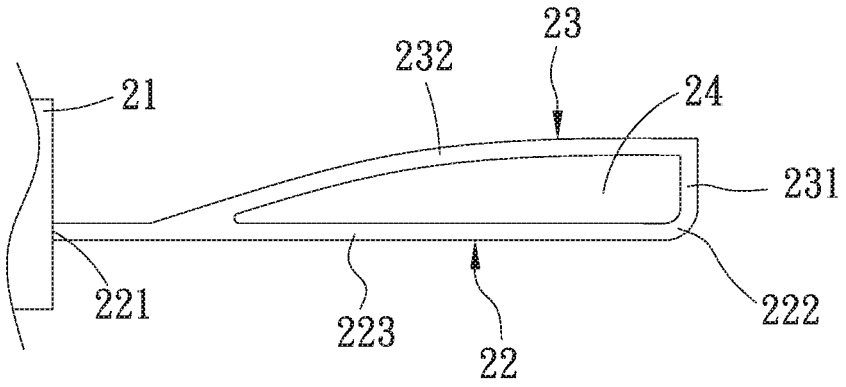
Figure 3D:
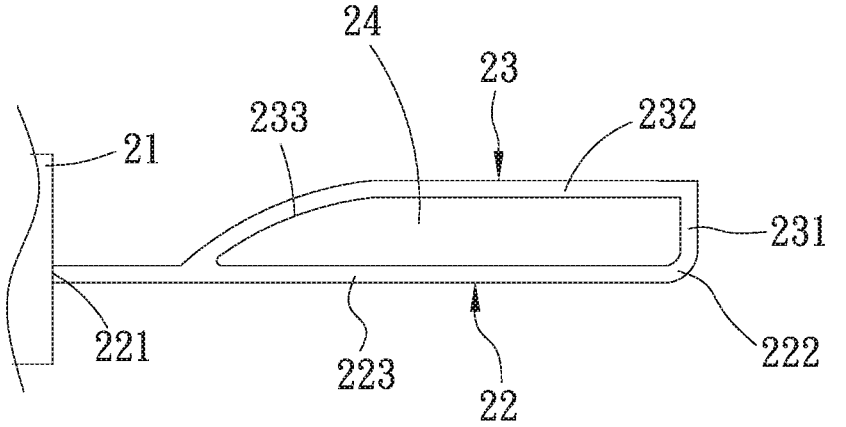
Figure 3E:
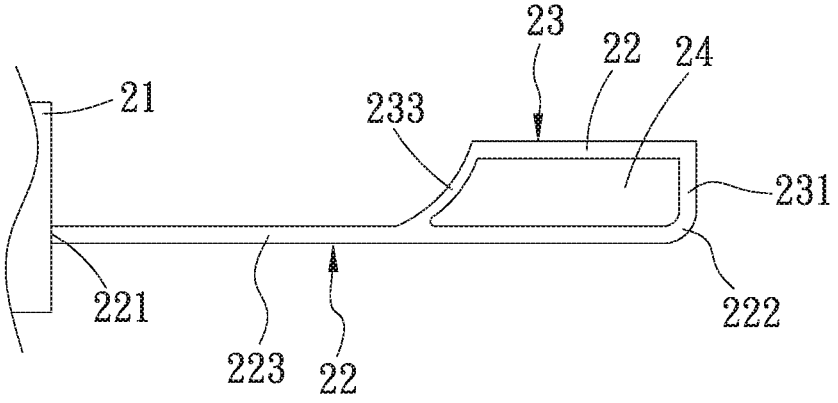
Figure 3F:
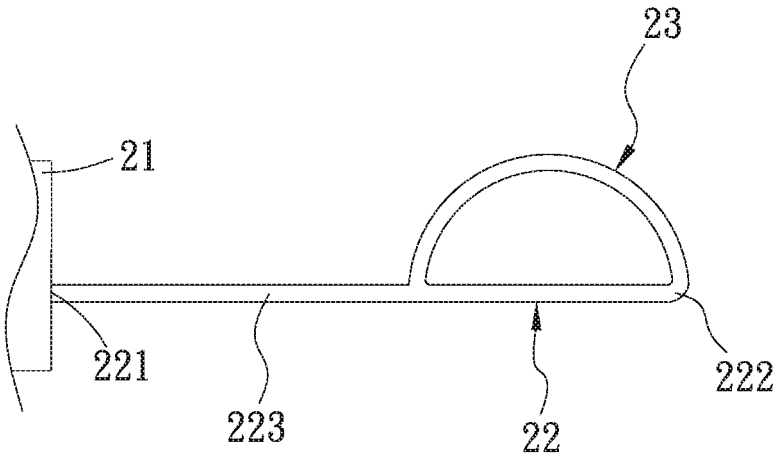
Figure 3G:
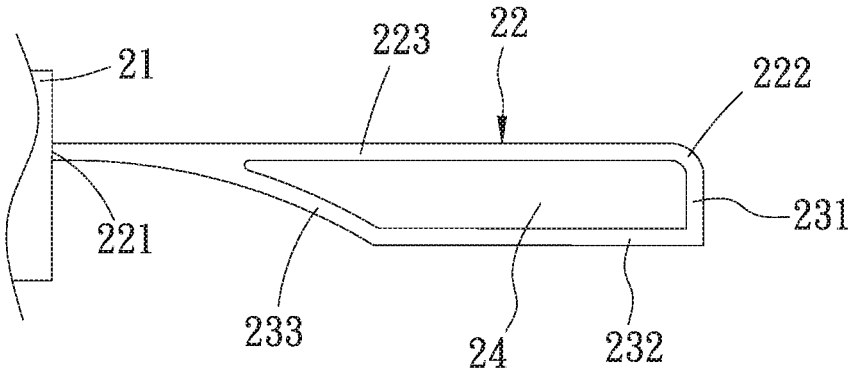
FIG. 3G is a sectional view showing that the subsidiary fan blade extends along the lower surface of the main fan blade.

In a preferred embodiment, the loop structure composed of the main fan blade 22 and the subsidiary fan blade 23 is a closed loop body. The subsidiary fan blade 23 extends from the free end section 222 of the main fan blade 22 to the upper surface 2231 of the main fan blade 22 (as shown in FIG. 2 and FIGS. 3A to 3E). In a modified embodiment, the subsidiary fan blade 23 extends from the free end section 222 of the main fan blade 22 to the lower surface 2232 of the main fan blade 22 (as shown in FIG. 3G). Moreover, the loop structure composed of the main fan blade 22 and the subsidiary fan blade 23 has a cross section having a closed hollow geometric configuration such as, but not limited to, trapezoidal shape (as shown in FIGS. 3A, 3D and 3G), rectangular shape (as shown in FIGS. 3B and 3E), curved shape (as shown in FIG. 3C), semicircular shape (as shown in FIG. 3F) or drip shape.

Figure 4A:
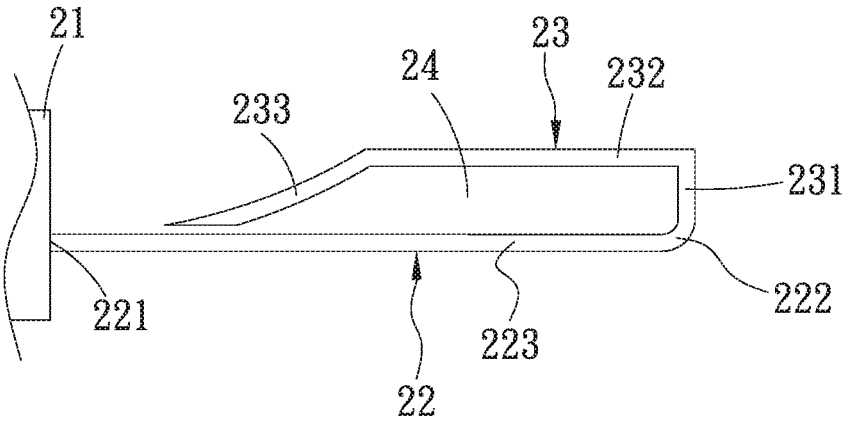
FIGS. 4A and 4B are sectional views showing that the loop structures are open loop bodies.
Figure 4B:
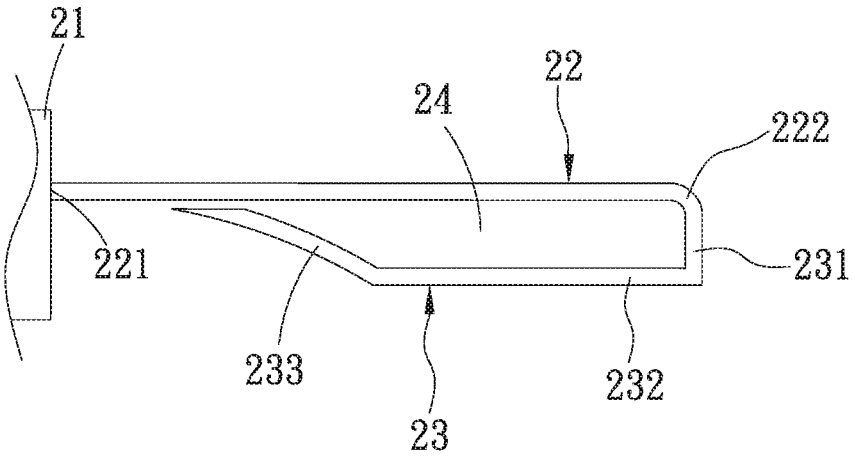

In a modified embodiment, as shown in FIGS. 4A and 4B, the loop structure composed of the main fan blade 22 and the subsidiary fan blade 23 can be alternatively an open loop body or a half-open loop body. The subsidiary fan blade 23 extends from the free end section 222 of the main fan blade 22 toward the root section 221 of the main fan blade 22 to one end of the main body section 223 without connecting with the upper surface 2231 or the lower surface 2232 of the main body section 223.

Figure 6A:
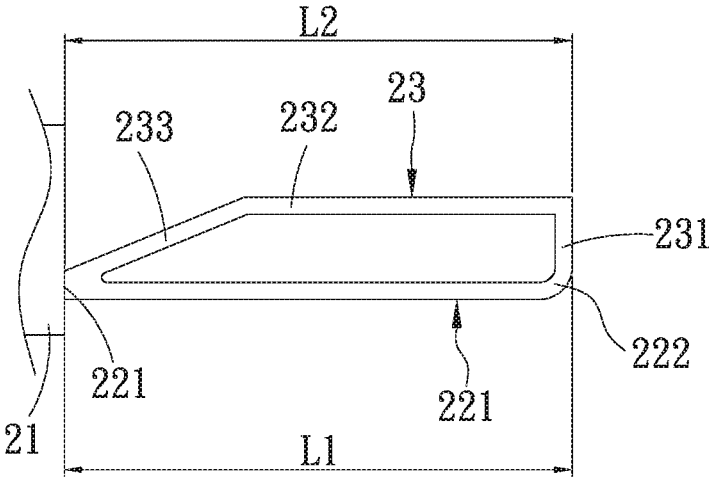
FIG. 6A is a sectional view of the heat dissipation fan blade structure of the present invention, showing that the extending length of the subsidiary fan blade is equal to the radial stretching length of the main fan blade.
Figure 6B:
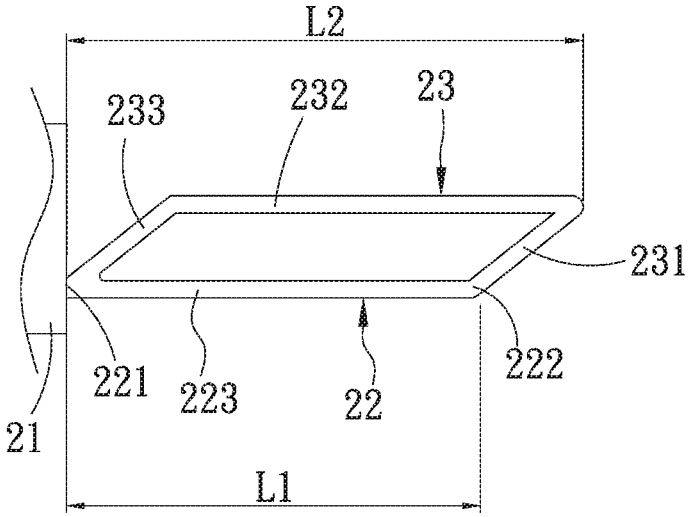
FIG. 6B is a sectional view of the heat dissipation fan blade structure of the present invention, showing that the extending length of the subsidiary fan blade is larger than the radial stretching length of the main fan blade.

It should be especially noted that the subsidiary fan blade 23 can be such as a three-section structure (as shown in FIGS. 3A, 3B, 3D, 3E, 3G, 4A and 4B). That is, the subsidiary fan blade 23 includes a first section 231, a second section 232 and a third section 233. One end of the first section 231 is connected with the free end section 222, while the other end of the first section 231 upward or downward extends. The second section 232 extends from the other end of the first section 231 toward the root section 221 of the main fan blade 22 to any position of the main fan blade 22, for example, to the middle or one-third or two-third length of the main fan blade 22. The third section 233 extends from the rear end of the second section 232 to the main body section 223 of the main fan blade 22. The first section 231 is normal to the free end section 222 or inclined to the free end section 222. In this embodiment, the first section 231 is normal to the free end section 222. The second section 232 is spaced from the main body section 223 of the main fan blade 22 in parallel thereto. The third section 233 perpendicularly or obliquely extends to the main body section 233. In a modified embodiment, the first section 231 is inclined to the free end section 222. (As shown in FIG. 6B, the first section 231 is, but not limited to, inclined to the right side of the drawing. Alternatively, the first section 231 can be inclined to the left side of the drawing).

Therefore, when the heat dissipation fan 20 operates, the first section 231 of the subsidiary fan blade 23 hinders the fluid under the main fan blade 22 from rolling to the upper side of the main fan blade 22 due to pressure difference. In this case, the vortices (also termed wingtip vortices) at the free end section 222 of the main fan blade 22 are reduced and the pneumatic noise is lowered. The second and third sections 232, 233 of the subsidiary fan blade 23 serve to increase the surface action area of the main fan blade 22 so as to greatly enhance wind pressure. Moreover, the subsidiary fan blade 23 extends from the free end section 222 of the main fan blade 22 to form the loop structure together with the main fan blade 22. This will not increase the solidity of the fan blades so that the air volume can be enhanced. With the wind pressure and air volume enhanced, the performance of the heat dissipation fan is promoted. The solidity of the fan blade means the chord length of the fan blade divided by the distance between two fan blades. The larger the solidity is, the denser the fan blades are.

In a modified embodiment, the subsidiary fan blade 23 can be such as a two-section structure (as shown in FIG. 3C). That is, the subsidiary fan blade 23 includes a first section 231 and a second section 232. The first section 231 is connected with the free end section 222 of the main fan blade 22. The second section 232 extends from the first section 231 toward the root section 221 of the main fan blade 22 to the main body section 223 of the main fan blade 22. The first section 231 is normal to the free end section 222 or inclined to the free end section 222. In this embodiment, the first section 231 is normal to the free end section 222. The second section 232 obliquely extends from one end of the first section 231 to the main body section 233. Therefore, when the heat dissipation fan 20 operates, the first section 231 of the subsidiary fan blade 23 hinders the fluid under the main fan blade 22 from rolling to the upper side of the main fan blade 22 due to pressure difference. In this case, the vortices (also termed wingtip vortices) at the free end section 222 of the main fan blade 22 are reduced and the pneumatic noise is lowered. The second section 232 of the subsidiary fan blade 23 serves to increase the surface action area of the main fan blade 22 so as to greatly enhance wind pressure. Moreover, the subsidiary fan blade 23 extends from the free end section 222 of the main fan blade 22 to form the loop structure together with the main fan blade 22. This will not increase the solidity of the fan blades so that the air volume can be enhanced. With the wind pressure and air volume enhanced, the performance of the heat dissipation fan is promoted.

Furthermore, the above-mentioned term "normal" means the angle contained between two components or two sections is 90 degrees. The above-mentioned term "inclined" means the angle contained between two components or two sections is larger than or smaller than 90 degrees.

Figure 5A:
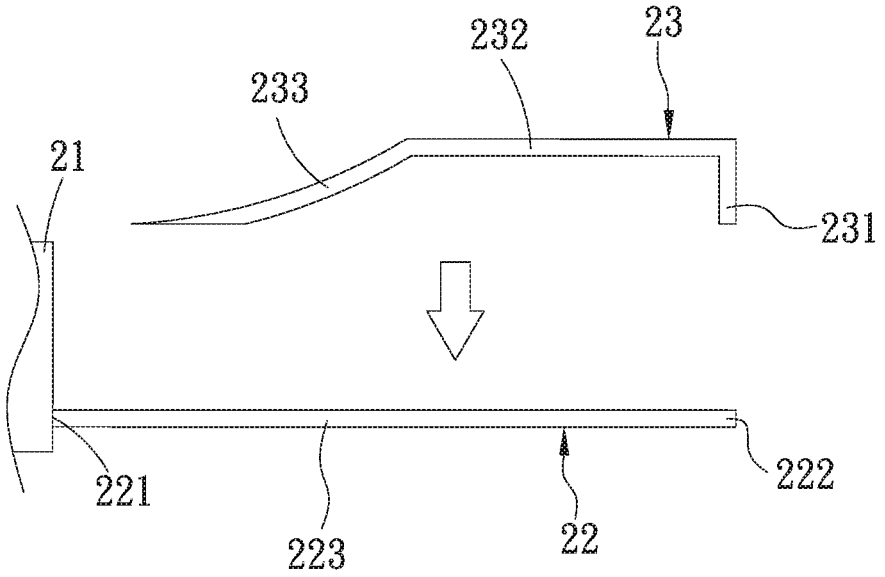
FIGS. 5A and 5B are sectional views showing that the main fan blade and the subsidiary fan blade of the heat dissipation fan blade structure of the present invention are two separate pieces of components, which are connected with each other.
Figure 5B:
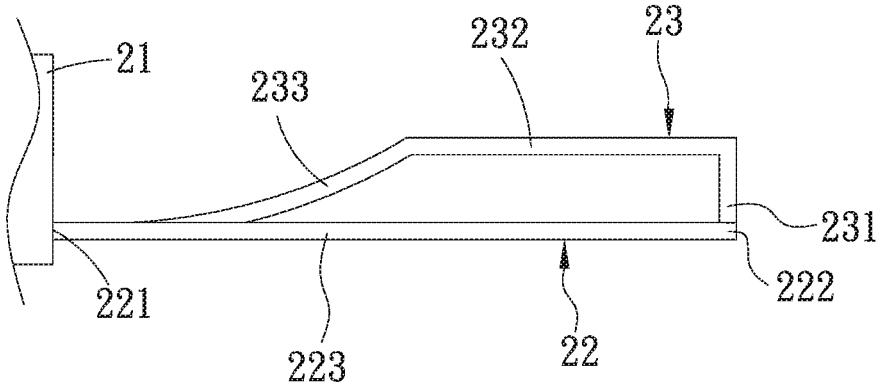

In addition, in the above embodiments, the main fan blade 22 and the subsidiary fan blade 23 are integrally formed. However, as shown in FIGS. 5A and 5B, in a modified embodiment, the main fan blade 22 and the subsidiary fan blade 23 are two separate pieces of components. The main fan blade 22 and the subsidiary fan blade 23 are connected with each other by means of riveting, latching, adhesion, locking, welding or fusion (such as ultrasonic or laser fusion). The material of the main fan blade 22 and the subsidiary fan blade 23 can be polymer material (such as plastic) or metal material or complex material. The main fan blade 22 and the subsidiary fan blade 23 can be made of identical material or different materials.

It should be also noted that as shown in FIG. 3A, the main fan blade 22 defines a radial stretching length L1 and the subsidiary fan blade 23 defines an extension length L2. The radial stretching length L1 is the straight-line distance between the root section 221 and the free end section 222. The extension length L2 is the straight-line distance of the extension lengths of the second and third sections 232, 233 of the subsidiary fan blade 23. The extension length L2 is, but not limited to, smaller than the radial stretching length L1. As shown in FIGS. 6A and 6B, in a modified embodiment, the extension length L2 defined by the subsidiary fan blade 23 is equal to the radial stretching length L1 of the main fan blade (as shown in FIG. 6A). Alternatively, the extension length L2 defined by the subsidiary fan blade 23 is larger than the radial stretching length L1 of the main fan blade (as shown in FIG. 6B). Therefore, according to the requirement of use, a user can adjust the extension length L2 of the subsidiary fan blade 23 to be smaller than, equal to or larger than the radial stretching length L1 of the main fan blade 22 so as to change the wind pressure and/or air volume and enhance the performance of the heat dissipation fan. Also, the force applied to local sections by the airflow can be distributed so as to reduce the deformation and lower the vibration problem of the fan blades.

According to the above arrangement, the present invention has the following advantages:

1. In operation, the wingtip vortices of the heat dissipation fan 20 are reduced.

2. The operational noise is lowered and the performances of wind pressure and air volume are enhanced.

3. The structural strength of the main fan blade 22 and the subsidiary fan blade 23 is increased. Also, the force applied to local sections by the airflow is distributed so as to reduce the deformation and lower the vibration problem of the fan blades.

4. The subsidiary fan blade 23 serves to increase the surface action area of the main fan blade 22 so as to greatly enhance the wind pressure.

5. The air volume can be enhanced without increasing the solidity of the fan blades.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A heat dissipation fan blade structure comprising:

a main fan blade having a root section and a free end section, the root section being connected with a hub, the free end section radially extending in a direction away from the hub, a main body section being formed between the root section and the free end section, the main body section having an upper surface and a lower surface;

a subsidiary fan blade extending from the free end section of the main fan blade toward the root section of the main fan blade to the main body section, the subsidiary fan blade and the main fan blade together forming an open loop structure defining a flow way between the main fan blade and the subsidiary fan blade to enhance the wind pressure and air volume;

wherein the main fan blade defines a radial stretching length and the subsidiary fan blade defines an extension length, the extension length being smaller than or larger than the radial stretching length; and wherein the subsidiary fan blade includes a first section, a second section and a third section, the third section extending from a rear end of the second section to the main body section of the main fan blade to form an inward curved surface, the subsidiary fan blade having an extending end disconnected from the main body section to form an open loop area, the second section of the subsidiary fan blade parallels the main body section of the main fan blade whereby in operation airflow through the flow way and out the open loop area becomes balanced to improve stability of the fan blade structure.

2. The heat dissipation fan blade structure as claimed in claim 1, wherein the subsidiary fan blade extends to the upper surface of the main body section.

3. The heat dissipation fan blade structure as claimed in claim 1, wherein the subsidiary fan blade extends to the lower surface of the main body section.

4. The heat dissipation fan blade structure as claimed in claim 1, wherein the loop structure has a cross section having a hollow configuration selected from a group consisting of trapezoidal shape, rectangular shape, curved shape, semicircular shape and drip shape.

5. The heat dissipation fan blade structure as claimed in claim 1, wherein the main fan blade and the subsidiary fan blade are integrally formed or are two separate pieces of components, which are connected with each other by means of riveting, latching, adhesion, locking, welding or fusion.

6. The heat dissipation fan blade structure as claimed in claim 1, wherein the subsidiary fan blade includes said first section and wherein said first section is connected with the free end section of the main fan blade, said second section extending from the first section toward the root section of the main fan blade and said third section extending from the second section to the main body section of the main fan blade.

7. The heat dissipation fan blade structure as claimed in claim 1, wherein the subsidiary fan blade includes said first section and wherein said first section is connected with the free end section of the main fan blade and said second section obliquely extending from the first section toward the root section of the main fan blade to the main body section of the main fan blade.

8. The heat dissipation fan blade structure as claimed in claim 1, wherein the main fan blade and the subsidiary fan blade are made of identical material or different materials, the materials of the main fan blade and the subsidiary fan blade being selected from a group consisting of polymer material, metal material and combinations thereof.

9. A heat dissipation fan comprising:

a hub;

multiple main fan blades disposed on outer circumference of the hub, each main fan blade having a root section and a free end section, the root section being connected with the hub, the free end section radially extending in a direction away from the hub, a main body section being formed between the root section and the free end section, the main body section having an upper surface and a lower surface;

multiple subsidiary fan blades, each subsidiary fan blade extending from the free end section of the main fan blade toward the root section to the main body section, the subsidiary fan blade and the main fan blade together forming an open loop structure defining a flow way between the main fan blade and the subsidiary fan blade to enhance the wind pressure and air volume;

wherein the main fan blade defines a radial stretching length and the subsidiary fan blade defines an extension length, the extension length being smaller than or larger than the radial stretching length; and wherein the subsidiary fan blade includes a first section, a second section and a third section, the third section extending from a rear end of the second section to the main body section of the main fan blade to form an inward curved surface and having an extending end disconnected from the main body section, the second section of the subsidiary fan blade parallels the main body section of the main fan blade.

10. The heat dissipation fan as claimed in claim 9, wherein the subsidiary fan blade extends to the upper surface of the main body section.

11. The heat dissipation fan as claimed in claim 9, wherein the subsidiary fan blade extends to the lower surface of the main body section.

12. The heat dissipation fan as claimed in claim 9, wherein the loop structure has a cross section having a hollow configuration selected from a group consisting of trapezoidal shape, rectangular shape, curved shape and semicircular shape.

13. The heat dissipation fan as claimed in claim 9, wherein the main fan blade and the subsidiary fan blade are integrally formed or are two separate pieces of components, which are connected with each other by means of riveting, latching, adhesion, locking, welding or fusion.

14. The heat dissipation fan as claimed in claim 9, wherein the subsidiary fan blade includes said first section and wherein said first section is connected with the free end section of the main fan blade, said second section extending from the first section toward the root section of the main fan blade and said third section extending from the second section to the main body section of the main fan blade.

15. The heat dissipation fan as claimed in claim 9, wherein the subsidiary fan blade includes said first section and wherein said first section is connected with the free end section of the main fan blade and said second section obliquely extending from the first section toward the root section of the main fan blade to the main body section of the main fan blade.

16. The heat dissipation fan as claimed in claim 9, wherein the main fan blade and the subsidiary fan blade are made of identical material or different materials, the materials of the main fan blade and the subsidiary fan blade being selected from a group consisting of polymer material, metal material and combinations thereof.

* * * * *